United States Patent [19]

Schonberg

[11] 3,933,503

[45] Jan. 20, 1976

[54] CARRIER FOR TRANSFERRING IMAGES

[76] Inventor: Herman Schönberg, Klostergatan 5, 582 23 Linkoping, Sweden

[22] Filed: May 6, 1974

[21] Appl. No.: 467,508

[52] U.S. Cl. ..... 96/85; 96/87 R; 428/422; 428/447; 428/452; 428/512; 428/519; 428/522; 428/537

[51] Int. Cl.[2] ... G03C 1/86; G03C 1/78; G03C 1/96

[58] Field of Search ..... 96/85, 87 R; 428/447, 422, 428/452, 512, 519, 522, 537

[56] References Cited

UNITED STATES PATENTS

| | | | |
|---|---|---|---|
| 2,653,884 | 9/1953 | Hussey et al. | 428/519 |
| 3,161,519 | 12/1964 | Alsup | 96/85 |
| 3,214,274 | 10/1965 | Ohyama et al. | 96/85 |
| 3,335,017 | 8/1967 | Spencer | 428/452 |
| 3,359,107 | 12/1967 | Goffe et al. | 96/87 R |
| 3,518,158 | 6/1970 | Hurst | 428/452 |
| 3,615,552 | 10/1971 | Danhawser et al. | 96/85 |
| 3,718,473 | 12/1973 | Gervay et al. | 96/87 R |
| 3,756,823 | 9/1973 | Haaf et al. | 96/85 |
| 3,788,856 | 1/1974 | Van Passchen et al. | 96/87 R |
| 3,811,933 | 5/1974 | Uffner | 428/422 |

*Primary Examiner*—Jack P. Brammer
*Attorney, Agent, or Firm*—Pierce, Scheffler & Parker

[57] ABSTRACT

A carrier for transferring images comprising a paper treated with a release agent and coated with a binder emulsion, the binder being chiefly based on nitrile butadiene rubber obtained by copolymerization of butadiene and acrylonitrile.

4 Claims, No Drawings

CARRIER FOR TRANSFERRING IMAGES

The present invention generally relates to transferring an image from an image carrier in the form of a sheet treated with a release agent and coated with a binder emulsion to an image receiver and in particular relates to a new binder in connection with said image transfer.

In prior art methods for transferring images first a carrier for instance in the form of paper is coated with wax-like substances or varnish, after which an image or a pattern is directly applied to the wax coating or to a new binder foil thereon. When transferring the image or image foil obtained in this manner to an image receiver high pressures and high heat are required. For releasing the image it is subsequently removed versely by using expensive chemicals. The image foil transferred to the image receiver has an uneven surface which must be polished, washed, dried and aftertreated with lacquer or the like. Expensive and complicated installations are also required for preparing the image carrier and for transferring the image to the image receiver.

It is the object of the present invention to provide image transfer with excellent results by using a type of binder in emulsified form novel in connection with image transfer. According to the invention the binder is a binder chiefly based on nitrile(butadiene)rubber (NBR) belonging to the group of contact adhesives. Nitrile rubber is synthetic rubber produced by emulsion polymerization of butadiene and acrylonitrile. The percentages of the two monomers will of course vary relatively to what qualities are desired but for the purpose according to the present invention a percentage of acrylonitrile of 25 to 35 % is preferred and the rest being butadiene. It has proved that the properties of nitrile rubber such as good aging properties and good heat resistance is advantageous in image transfer using an image carrier treated with a release agent. The binder emulsion based on nitrile rubber has preferably a solid content of 25 to 40 % although the solid content may be higher or lower. It is obvious that the solid content is selected relatively to how quick drying the emulsion should be. As solvents it is preferable to use ketones, such as acetone, methyl ethyl ketone, and the like but also other volatile solvents may be used. The binder is colorless and transparent which is an essential advantage in image transfer since slightly coloured binders will else influence the image transfer. According to the invention it is proved that a preferable contact adhesive based on nitrile rubber is a glue marketed under the designation "Bostik 1782" by Bostik AB, Helsingborg, Sweden. Said glue is chiefly based on nitrile rubber dissolved in organic solvents such as ketones. The other technical data will be clear from the tabel below.

| | |
|---|---|
| Type of glue | Contact adhesive |
| Binders | Nitrile rubber, synthetic resins |
| Solvent | Ketones |
| Type of glue | Contact adhesive |
| Colour | Colourless, transparent |
| Smell | The same as for the solvents (cf. the above) |
| Consistence | Very liquid |
| Solid content | 25±% by weight |
| Specific gravity | 0.87±0.02 |
| Viscosity | 50±4 poise at 20°C (Brookfield RVF spindle 3, 10 rotations per minute) |
| Flash point | Below 21°C |

A modified form of the contact adhesive described above which has proved suitable according to the invention is the same glue with the exception that the solid content is about 40 %. Such a glue is of course quicker in drying.

The expression "chiefly based on nitrile rubber" implies that also other synthetic resins may be included in the binder. As to these resins it is often a secret to the manufacturer of said glues which resins are included and so it is practically impossible to clearly define them.

The invention will be described below with reference to the production of an image carrier which may be used in transferring images. To produce the image carrier the starting material is paper treated with a release agent, i.e. a paper treated with such release agents as silicones, polyethylene, polytetrafluorethylene or the like, on which paper a binder emulsion according to the invention in the form of a thin film is applied. On this film after it has dried an image may be printed in offset gravure, letter press or by other conventional printing methods or the image may be transferred or moved from an image printed on a coated sheet to the emulsion film of the release agent paper. Transfer from the image carrier to an image receiving surface is chiefly effected by heat and under weak pressure. The use of the above binders chiefly based on nitrile rubber has the following advantages. The binder will stick to the sheet treated with a release agent in a satisfactory manner and the image film applied on the image carrier is kept perfectly at the transfer, is weak, resilient and tensile and will perfectly follow for instance knitted fabric, coarse artist canvas or any other surface having a rough and uneven structure. The image carrier thus provided with the image film will endure high temperatures and the image film after it has been transferred for instance to plastics packaging can even be made flame-proof. With a sheet treated with the release agent and coated with the binder emulsion according to the invention transfer can take place from the images printed on the sheet to the emulsion film. Images transferred from paper will be as perfect as the original image. In such image transfer the image may be printed on a so-called coated paper, preferably with such coating as on paper in American magazines. An image of such paper is placed against the emulsion film and squeezed by means of a pressure of approximately 3 kg/cm$^2$ at a temperature of 100° to 150°C for some seconds. The image is now embedded into the emulsion film. If the image carrier is placed against the image paper on or above the surface of preferably hot water the coating of the paper is dissolved and the paper can be restripped from the image almost by itself. The image is then cleansed from the remainder of the coating of the paper. Also hot steam may be used to strip the paper from the image.

When transferring an image from the image carrier this can be effected at a greater speed if the image carrier is heated for some seconds to 150° to 200°C before it is transferred. With a preheated image carrier the time for image transfer will be substantially reduced. If a dim surface is desired for instance on an image transferred to cloth the transfer moment may be prolonged and the temperature increased whereby the transparent polyethylen- or silicone coating for instance will melt and merge with the picture.

The carrier coated with the binder emulsion according to the invention on which an image has been applied is often provided with an extra binder relatively to the image receiving surface. Said extra binder preferably comprises a binder based on an acrylic resin preferably in the form of a latex. Said acrylic resin consists of a thermoplastic polymer or copolymer of acrylic acid, methacrylic acid, esters of these acids or acrylonitrile. Typical acrylic binders have a solid content of approximately 46 % and have a specific gravity of approximately 1.06. This binder gives rise to a semi-blurred surface.

After the image transfer the emulsion applied to the paper treated with the release agent according to the invention will be located at the outer side of the image. Therefore, according to the invention, it is important that the emulsion is transparent. The emulsion film also protects the image against mechanical and chemical influences.

According to a preferred embodiment of the invention a thin layer of a photosensitive photographic emulsion is applied on the binder layer. This is advantageous since a photograph can be developed directly onto the carrier bearing the binder layer of the invention. The photosensitive emulsion is coated as a layer about 1/2000 inch thick or less on the binder layer. The emulsion can consist of (1) Gelantine, (2) Microcrystalline (that is very finely divided as invisibly minute crystals) silver bromide with usually few per cent of silver iodide, and (3) Small amounts of various other chemicals added for special purposes. These include: sensitizing dyes to make the emulsion colour-sensitive, a hardening agent to make the gelantine less tender in hot weather; a bactericide to prevent bakteria attacking the gelantine in hot, damp weather or climates; a wetting agent to facilitate the after process of development, etc. and, usually, an antifoggant.

It has been established that the use of a binder chiefly based on nitrile rubber will yield the following advantages when transferring an image from an image carrier treated with a release agent to an image receiver.

1. The image film has a high polish, almost glittering even surface.

2. After the transfer the printed image will be located at the inner side of the emulsion film (the image film), whereby the image is protected against chemical and mechanical influences.

3. The image film is resilient, tensile and will follow even the structure in cloth permitting the use thereof in molded objects, tensile cloth or foils, such as knitted fabrics, stockings, plastics foil, skin.

4. The image foil transferred for instance to cloth can be boiled, washed as fine laundry and even dry-cleaned in so-called hard machine laundry with perfect results. The image film will endure heat corresponding to a temperature higher than 200°C and can be flame-treated for instance when it is attached to the plastics packaging.

5. In the transferred state the image film need not be after-treated for instance by polishing, washing, drying, lacquering, etc.

6. When the image film is still attached to the image carrier for instance silicone paper (carrier with a layer of a release agent) it endures storing and transporting and can be marketed.

7. The image film can be transferred to almost any conceivable material and using weak contact pressure. For instance it can be transferred to cloth and foil in a continuous web at a great speed.

8. A transfer of the image film can take place at the usual room temperature and the binder emulsion will dry in a matter of a few minutes. The time for drying is reduced by heat to approximately 4 to 5 seconds. Water is not needed for releasing the image carrier resulting in great economy in working and installation costs since washing, drying and possible ironing will be eliminated.

What I claim is:

1. A carrier for transferring images to an image receiver comprising a paper treated with a release agent selected from the group consisting of silicones, polyethylene, and polytetrafluoroethylene, and a transparent binder suspension layer disposed thereon, said binder suspension consisting essentially of a solid suspension in a solvent, said solid comprising a nitrile butadiene rubber obtained by copolymerizing butadiene with acrylonitrile.

2. Image carrier according to claim 1, wherein the binder emulsion has a solid content of 25 to 40 %, the rest being ketone solvents.

3. Image carrier according to claim 1, characterized in that said nitrile butadiene rubber is obtained by copolymerization of 25 to 35 % of acrylonitrile, the rest being butadiene.

4. A carrier for transferring images to an image receiver comprising a paper treated with a release agent selected from the group consisting of silicones, polyethylene, and polytetrafluoroethylene, and a binder suspension layer disposed thereon, said binder suspension consisting essentially of a solid suspended in a solvent, said solid comprising a nitrile butadiene rubber obtained by copolymerizing butadiene with acrylonitrile, said carrier further comprising a thin layer of photosensitive photographic emulsion overlying the binder suspension layer.

* * * * *